US008844243B1

(12) United States Patent
Gillman

(10) Patent No.: US 8,844,243 B1
(45) Date of Patent: Sep. 30, 2014

(54) METHOD OF CONNECTING STRUCTURAL INSULATED BUILDING PANELS THROUGH CONNECTING SPLINES

(71) Applicant: Jerry Gillman, Miami, FL (US)

(72) Inventor: Jerry Gillman, Miami, FL (US)

( * ) Notice: Subject to any disclaimer, the term of this patent is extended or adjusted under 35 U.S.C. 154(b) by 0 days.

(21) Appl. No.: 14/198,938

(22) Filed: Mar. 6, 2014

Related U.S. Application Data

(60) Provisional application No. 61/773,489, filed on Mar. 6, 2013.

(51) Int. Cl.

| | |
|---|---|
| ***E04C 2/26*** | (2006.01) |
| ***E04C 2/38*** | (2006.01) |
| ***E04C 2/284*** | (2006.01) |
| ***E04B 1/66*** | (2006.01) |
| ***E04B 2/02*** | (2006.01) |

(52) U.S. Cl.
CPC . *E04C 2/38* (2013.01); *E04C 2/284* (2013.01); *E04B 1/66* (2013.01); *E04B 2/02* (2013.01)
USPC ..... 52/745.2; 52/745.19; 52/747.1; 52/309.9; 52/586.1; 52/585.1

(58) Field of Classification Search
CPC ..... E04B 1/14; E04B 1/6154; E04B 1/6262
USPC ..... 52/782.1, 745.2, 745.19, 747.1, 748, 1, 52/582.1–582.2, 583.1, 584.1, 587.1, 52/586.1–586.2, 585.1, 309.4, 309.9, 52/309.13, 309.14, 309.5
See application file for complete search history.

(56) References Cited

U.S. PATENT DOCUMENTS

| | | | | |
|---|---|---|---|---|
| 3,223,576 | A * | 12/1965 | Evans et al. | 428/218 |
| 4,765,105 | A * | 8/1988 | Tissington et al. | 52/309.11 |
| 5,950,389 | A * | 9/1999 | Porter | 52/586.1 |
| 5,992,110 | A * | 11/1999 | Clear | 52/271 |
| 6,006,480 | A * | 12/1999 | Rook | 52/309.12 |
| 2009/0113820 | A1 * | 5/2009 | Deans | 52/169.14 |
| 2009/0293395 | A1 * | 12/2009 | Porter | 52/309.1 |

* cited by examiner

*Primary Examiner* — Jeanette E Chapman

(57) ABSTRACT

An arbitrary structural insulated panel and an adjoining structural insulated panel, which include magnesium oxide boards as the exterior panels, can be connected together by a first spline and a second spline. The arbitrary structural insulated panel is first connected to a building floor foundation. Then the first spline and the second spline are adhered into the arbitrary structural insulated panel. The adjoining structural insulated panel is then secured to the arbitrary structural insulated panel as the first spline and the second spline engage with the adjoining structural insulated panel. A plurality of fasteners is used as the final step to further secure the arbitrary structural insulated panel and the adjoining structural insulated panel.

6 Claims, 11 Drawing Sheets

METHOD OF CONNECTING STRUCTURAL INSULATED BUILDING PANELS THROUGH CONNECTING SPLINES

The current application claims a priority to the U.S. Provisional Patent application Ser. No. 61/773,489 filed on Mar. 6, 2013.

FIELD OF THE INVENTION

The present invention relates generally a method for structurally connecting load bearing insulated building panels. More specifically, the present invention uses a laminated spline that it is made of a magnesium oxide board and a phenolic resin layer in order to form a unique spline that is superior in strength, fire rating and greatly reduces thermal bridging at the connection joint.

BACKGROUND OF THE INVENTION

Load bearing insulated building panels are composite building materials of an insulating layer of rigid polymer foam sandwiched between two layers of structural board. These structural boards can consist of material such as sheet metal, plywood, particle board, etc. while the insulating layer of rigid polymer foam is commonly expanded polystyrene foam, extruded polystyrene foam, polyisocyanurate foam, or polyurethane foam. The load bearing insulated building panels can be used within many different construction applications, such as exterior walls, interior walls, roofs, floors, and foundation systems since the structural insulated panels combine the functionality of the conventional building components, such as studs, joists, insulation, vapor barrier, and air barrier. However, a connection issue occurs within the load bearing insulated building panels when the structural boards of the load bearing insulated building panels are made from magnesium oxide boards. Builders normally face with the connection issue in between multiple load bearing insulated building panels due to the soft in nature and poor attachment pullout strength of the magnesium oxide board, making structural applications difficult without the use of combustible material splines such as wood which greatly reduces the thermal efficiency of the panel system.

It is therefore an object of the present invention to provide a method to improve the connection in between multiple load bearing insulated building panels when the load bearing insulated building panels have magnesium oxide boards as the structural skin of the panels. The unique spline that is used within the present invention is superior in strength and fire rating compare to the conventional splines and greatly reduces the thermal bridging that typically occurs at the panel joints with other common connection methods.

DETAIL DESCRIPTIONS OF THE INVENTION

All illustrations of the drawings are for the purpose of describing selected versions of the present invention and are not intended to limit the scope of the present invention.

The present invention is a method of connecting the structural insulated building panel through connecting splines. The method of connecting the multiple structural insulated building panels are explained in relation to an arbitrary structural insulated panel 1, an adjoining structural insulated panel 2, a first spline 11, and a second spline 12.

Figure 1:
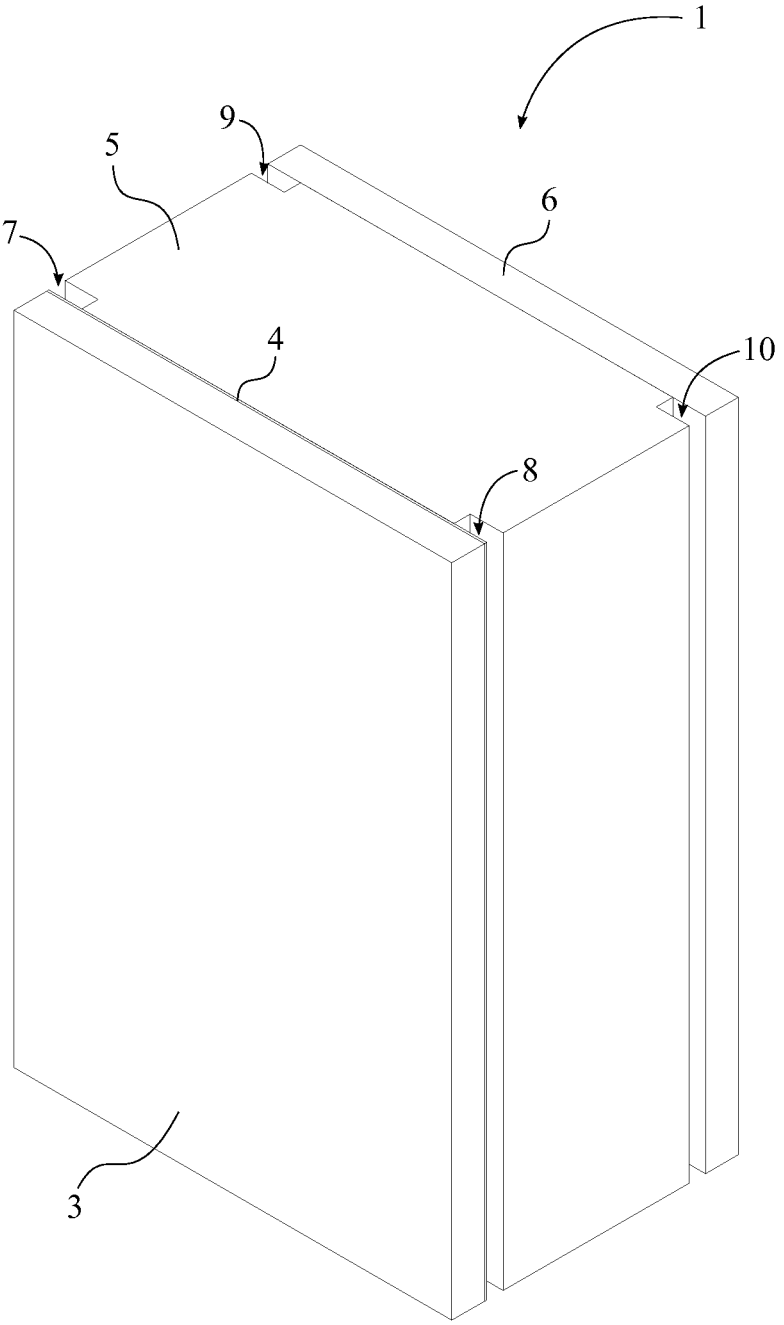
FIG. 1 is a perspective view of the arbitrary structural insulated panel of the present invention.
Figure 2:
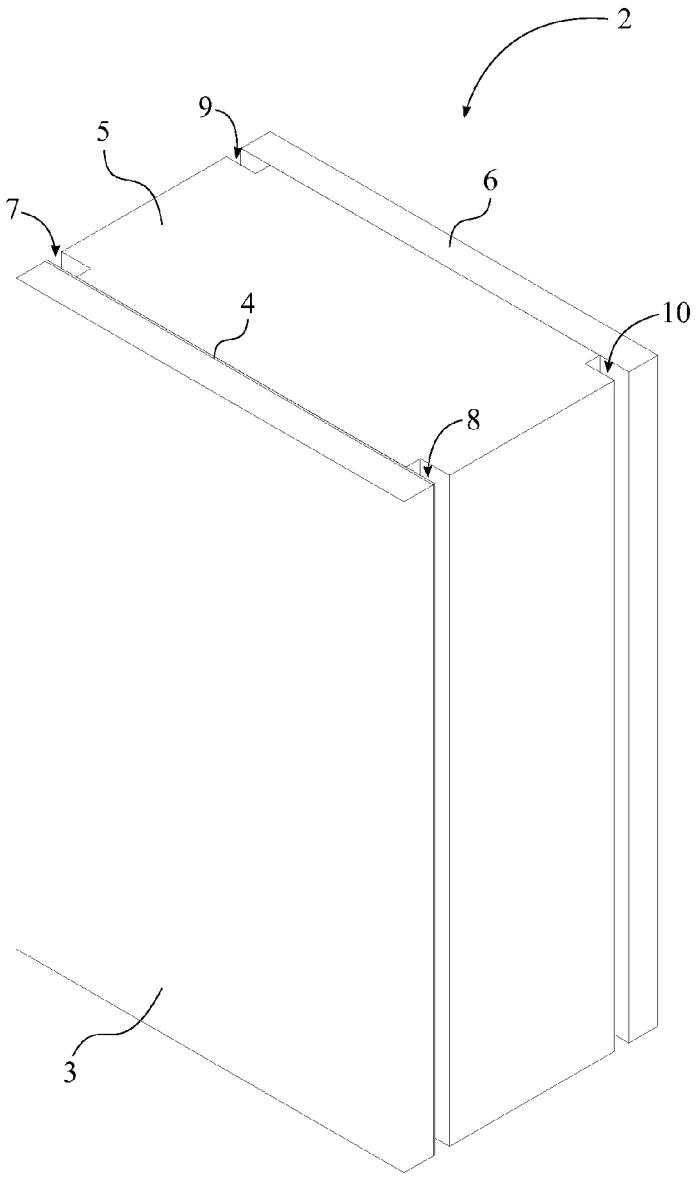
FIG. 2 is a perspective view of the adjoining structural insulated panel of the present invention.

In reference to FIG. 1 and FIG. 2, the arbitrary structural insulated panel 1 and the adjoining structural insulated panel 2 each comprise a first magnesium oxide (MgO) board 3, a phenolic resin sheet 4, an expanded polystyrene layer 5, and a second magnesium oxide (MgO) board 6. The phenolic resin sheet 4 is adjacently laminated with the expanded polystyrene layer 5 as the phenolic resin sheet 4 improves the fire resistance within the structural insulated panels while providing superior impact absorbance to the structural insulated panels. The phenolic resin sheet 4 is a lightweight, chemical resistance material, wherein those materialistic properties of the phenolic resin sheet 4 improve the overall functionality of the structural insulated panel. The phenolic resin sheet 4 also acts as a thermal barrier for the structural insulated panels, where the phenolic resin sheet 4 does not burn and is heat resistant, thereby providing a thermal barrier at the structural insulated panel joints blocking moisture and heat transfer. The expanded polystyrene layer 5 is a thermoplastic, closed-cell, lightweight, and rigid-foam material, where the expanded polystyrene layer 5 provides low thermal conductivity, high compressive strength, and shock absorbing properties to the structural insulated panels. The first MgO board 3 is adjacently laminated to the phenolic resin sheet 4 in such way that the first MgO board 3 is oppositely positioned from the expanded polystyrene layer 5. The second MgO board 6 is adjacently laminated to the expanded polystyrene layer 5, where the second MgO board 6 is oppositely positioned from the phenolic resin sheet 4. The first MgO board 3 and the second MgO board 6 provide high strength, fire resistance, mold and mildew control, and sound control functionality to the structural insulated panels. In reference to general structural construction, the first MgO board 3 is generally aligned as the exterior wall surface of the structural building while the second MgO board 6 is generally aligned as the interior wall surface of the structural building. Once the first MgO board 3, the phenolic resin sheet 4, the expanded polystyrene layer 5, and the second MgO board 6 are securely laminated with each other, the first MgO board 3, the phenolic resin sheet 4, the expanded polystyrene layer 5, and the second MgO board 6 are able to from a single rigid panel.

Since the first MgO board 3 and the phenolic resin sheet 4 are laminated to each other, the phenolic resin sheet 4 converts the brittleness of the MgO board into high impact panel so that the structural insulated panels are able to withstand high impact forces and high stress forces. In other words, the first MgO board 3 and the phenolic resin sheet 4 form a non-brittle outer layer within the structural insulated panels.

Even though the structural insulated panels use laminating as the preferred connection method, the structural insulated panels can utilize any other type of connection methods or any other type adhesive materials, such as high pressure bonding, mechanical fasteners, and adhesive, to connect the first MgO board 3, the phenolic resin sheet 4, the expanded polystyrene layer 5, and the second MgO board 6 together.

The first MgO board 3, the phenolic resin sheet 4, the expanded polystyrene layer 5, and the second MgO board 6 each comprise a first edge and a second edge. More specifically, the first edge of the first MgO board 3, the phenolic resin sheet 4, the expanded polystyrene layer 5, and the second MgO board 6 are oppositely positioned from the second edge of the first MgO board 3, the phenolic resin sheet 4, the expanded polystyrene layer 5, and the second MgO board 6.

In reference to the first configuration of the structural insulated panels, the first edge of the first MgO board 3, the phenolic resin sheet 4, the expanded polystyrene layer 5, and the second MgO board 6 are coincidentally positioned with each other so that the all of the first edges are able to create a flat surface within the structural insulated panels. Similarly, the second edge of the first MgO board 3, the phenolic resin sheet 4, the expanded polystyrene layer 5, and the second MgO board 6 are coincidentally positioned with each other so that the all of the second edges are able to create a flat surface within the structural insulated panels In reference to the second configuration of the structural insulated panels, the first edge of the first MgO board 3, the phenolic resin sheet 4, the expanded polystyrene layer 5, and the second MgO board 6 are coincidentally positioned with each other so that the all of the first edges are able to create a flat surface within the structural insulated panels. Similar to the first configuration, the second edge of the first MgO board 3, the expanded polystyrene layer 5, and the second MgO board 6 are coincidentally positioned with each other; however, the second edge of the phenolic resin sheet 4 is extended from the second edge of the first MgO board 3, the expanded polystyrene layer 5, and the second MgO board 6 so that a seal section can be formed within the structural insulated panels. The seal section function as a moisture barrier in between the arbitrary structural insulated panel 1 and the adjoining structural insulated panel 2 to stop moisture penetration.

In reference to FIG. 1 and FIG. 2, the arbitrary structural insulated panel 1 and the adjoining structural insulated panel 2 each further comprise a first lateral channel 7, a second lateral channel 8, a third lateral channel 9, and a fourth lateral channel 10. The first lateral channel 7 and the second lateral channel 8 are adjacently positioned with the first MgO board 3 in such way that the first lateral channel 7 and the second lateral channel 8 are positioned opposite to each other across the expanded polystyrene layer 5. More specifically, the first lateral channel 7 is traversed into the expanded polystyrene layer 5, where the first lateral channel 7 is adjacently positioned with the first edges. The second lateral channel 8 is traversed into the expanded polystyrene layer 5, where the second lateral channel 8 is adjacently positioned with the second edge opposite from the first lateral channel 7. The third lateral channel 9 and the fourth lateral channel 10 are adjacently positioned with the second MgO board 6 in such way that the third lateral channel 9 and the fourth lateral channel 10 are positioned opposite to each other across the expanded polystyrene layer 5. More specifically, the third lateral channel 9 is traversed into the expanded polystyrene layer 5, where the third lateral channel 9 is adjacently positioned with the first edges. The fourth lateral channel 10 is traversed into the expanded polystyrene layer 5, where the fourth lateral channel 10 is adjacently positioned with the second edge opposite from the third lateral channel 9. Additionally, the first lateral channel 7 and the third lateral channel 9 are adjacently positioned with each other adjacent to the first edge, and the second lateral channel 8 and the fourth lateral channel 10 are adjacently positioned with each other adjacent to the second edge.

Figure 3:
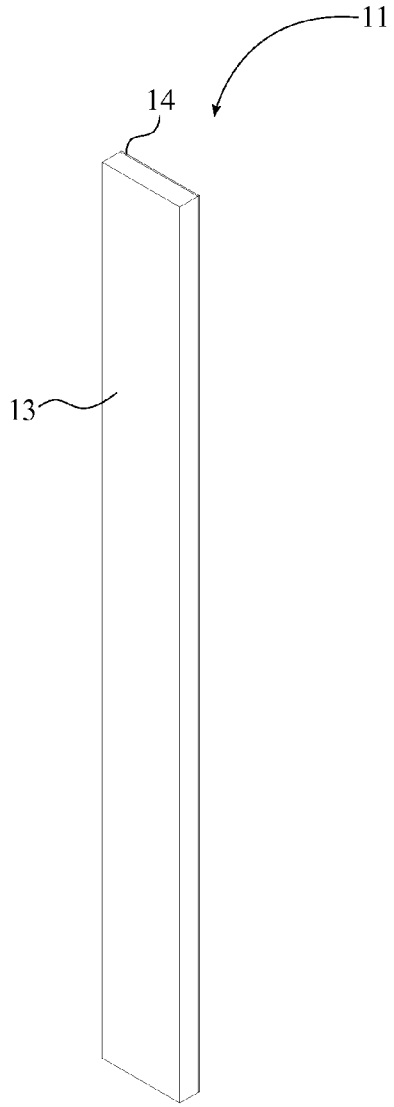
FIG. 3 is a perspective view of the first spline of the present invention.
Figure 4:
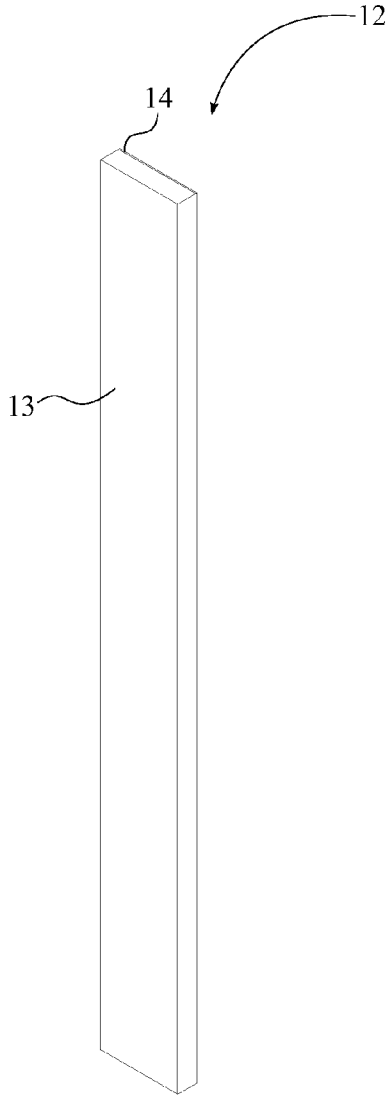
FIG. 4 is a perspective view of the second spline of the present invention.

In reference to FIG. 3 and FIG. 4, the first spline 11 and the second spline 12 each comprise a magnesium oxide board section 13 and a phenolic resin sheet section 14, where the magnesium oxide board section 13 and the phenolic resin sheet section 14 are adjacently laminated with each other. Similar to the structural insulated panels, the phenolic resin sheet section 14 converts the brittleness of the magnesium oxide board section 13 into high impact splines so that the first spline 11 and the second spline 12 are able to withstand high impact forces and high stress forces during the present invention.

The method of connecting the arbitrary structural insulated panel 1 and the adjoining structural insulated panel 2 is shown in FIG. 8-FIG. 11, the arbitrary structural insulated panel 1 is first positioned on a building floor foundation, where the arbitrary structural insulated panel 1 is perpendicularly positioned with the building floor foundation. More specifically, the first MgO board 3 is positioned as the exterior wall surface, and the second MgO board 6 is positioned as the interior wall surface. As a result, the first lateral channel 7 and the second lateral channel 8 of the arbitrary structural insulated panel 1 position towards the exterior wall surface, and the third lateral channel 9 and the fourth lateral channel 10 of the arbitrary structural insulated panel 1 position towards the interior wall surface. Then the arbitrary structural insulated panel 1 is secured to the building floor foundation by a plurality of fastener, where the plurality of fasteners can include, but is not limited to, screws and adhesive materials. After the arbitrary structural insulated panel 1 is secured, a first spline 11 and the second spline 12 are adhered to the arbitrary structural insulated panel 1.

Figure 5:
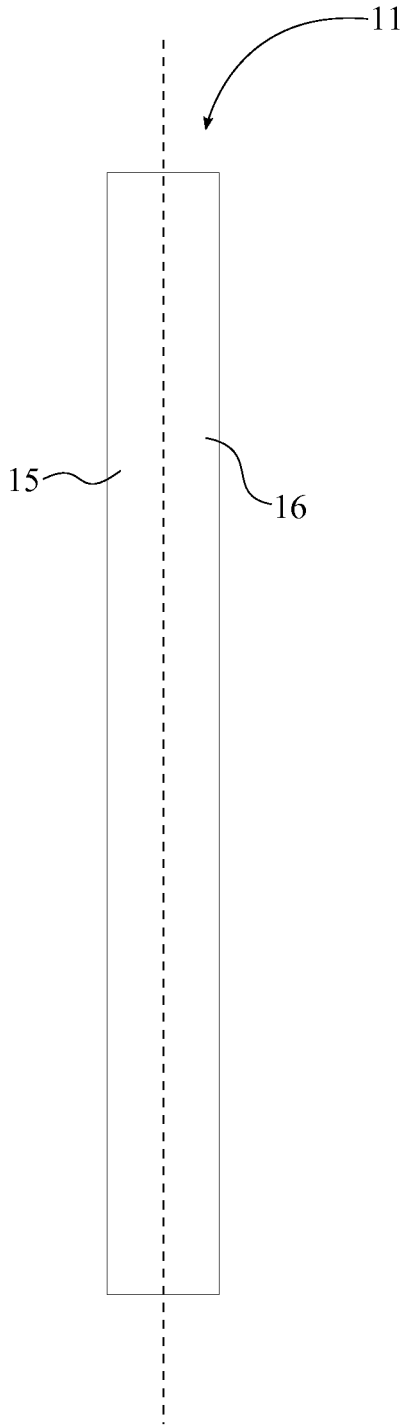
FIG. 5 is a front view of the first spline of the present invention, showing the first half portion and the second half portion.
Figure 6:
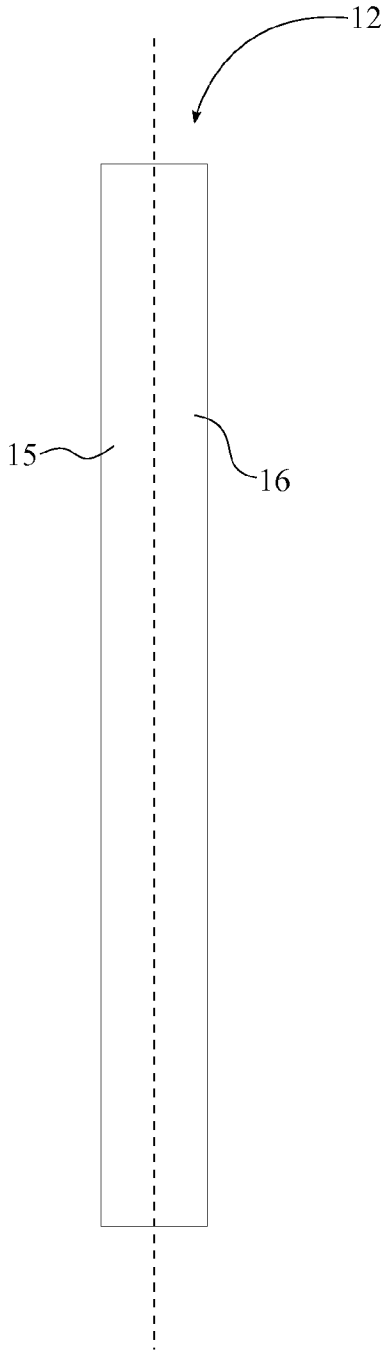
FIG. 6 is a front view of the second spline of the present invention, showing the first half portion and the second half portion.
Figure 7:
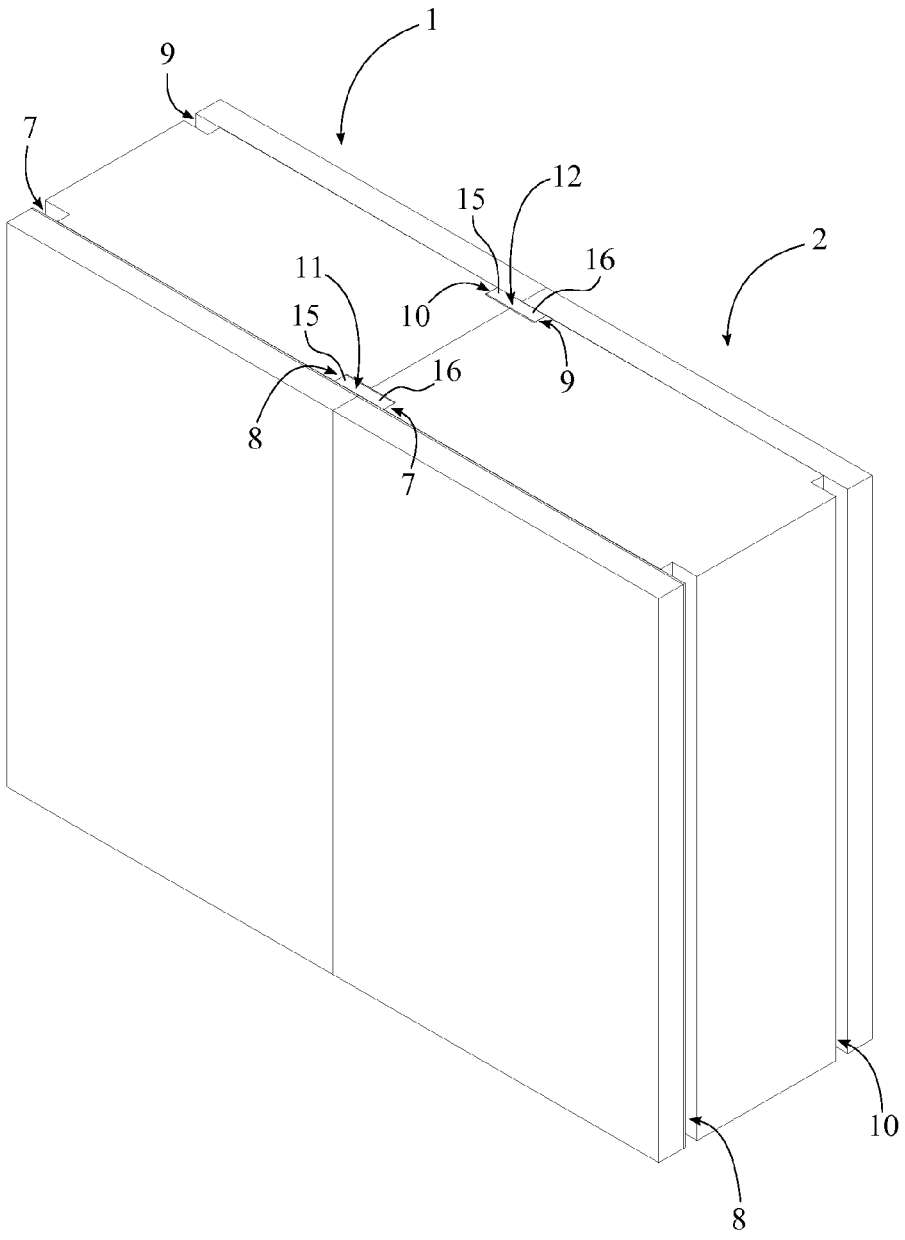
FIG. 7 is a perspective view of the arbitrary structural insulated panel and the adjoining structural insulated panel, wherein the arbitrary structural insulated panel and the adjoining structural insulated panel are secured together with the first spline and the second spline.
Figure 8:
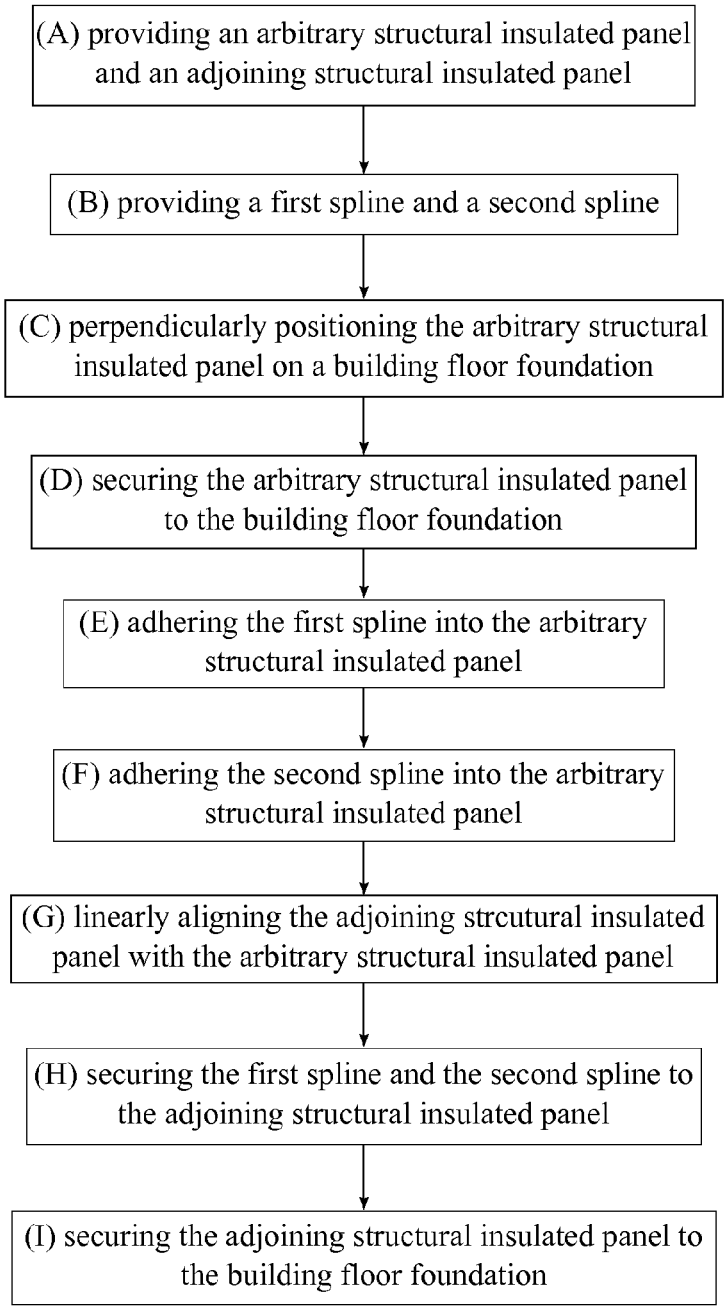
FIG. 8 is a basic flow chart illustrating the overall method of connecting the arbitrary structural insulated panel and the adjoining structural insulated panel.
Figure 9:
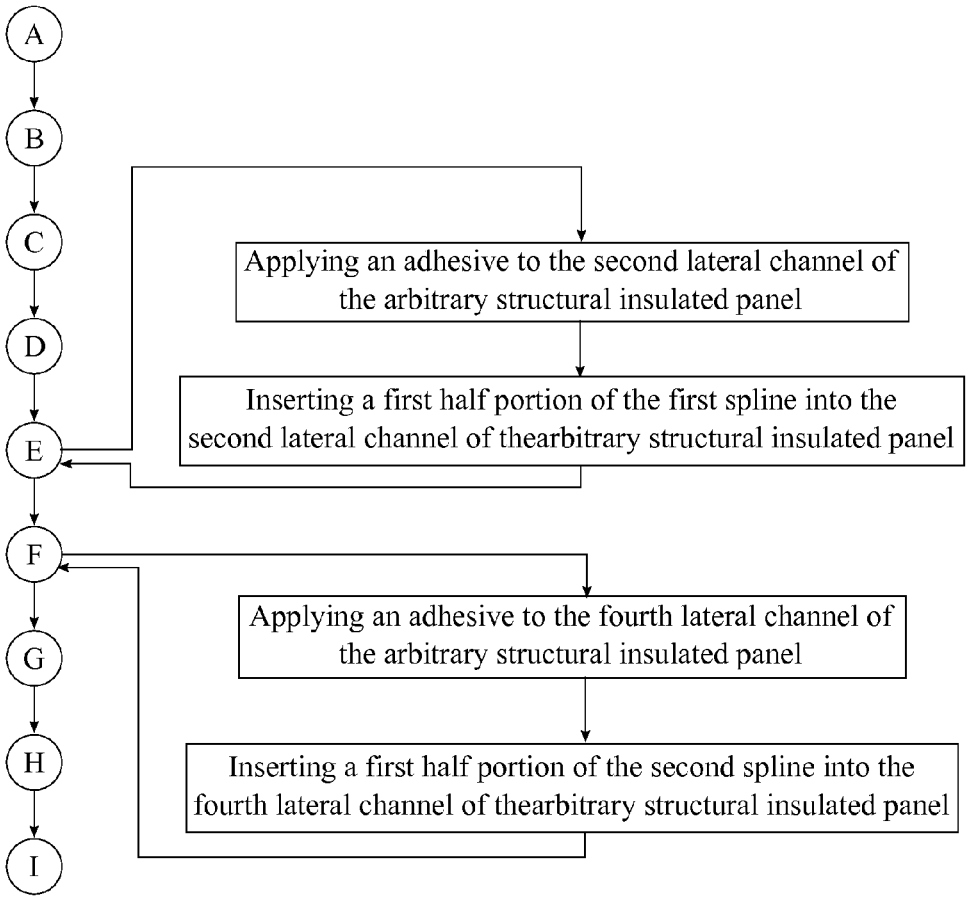
FIG. 9 is a basic flow chart illustrating the method of adhering of the first spline and the second spline within the overall method of the present invention.
Figure 10:
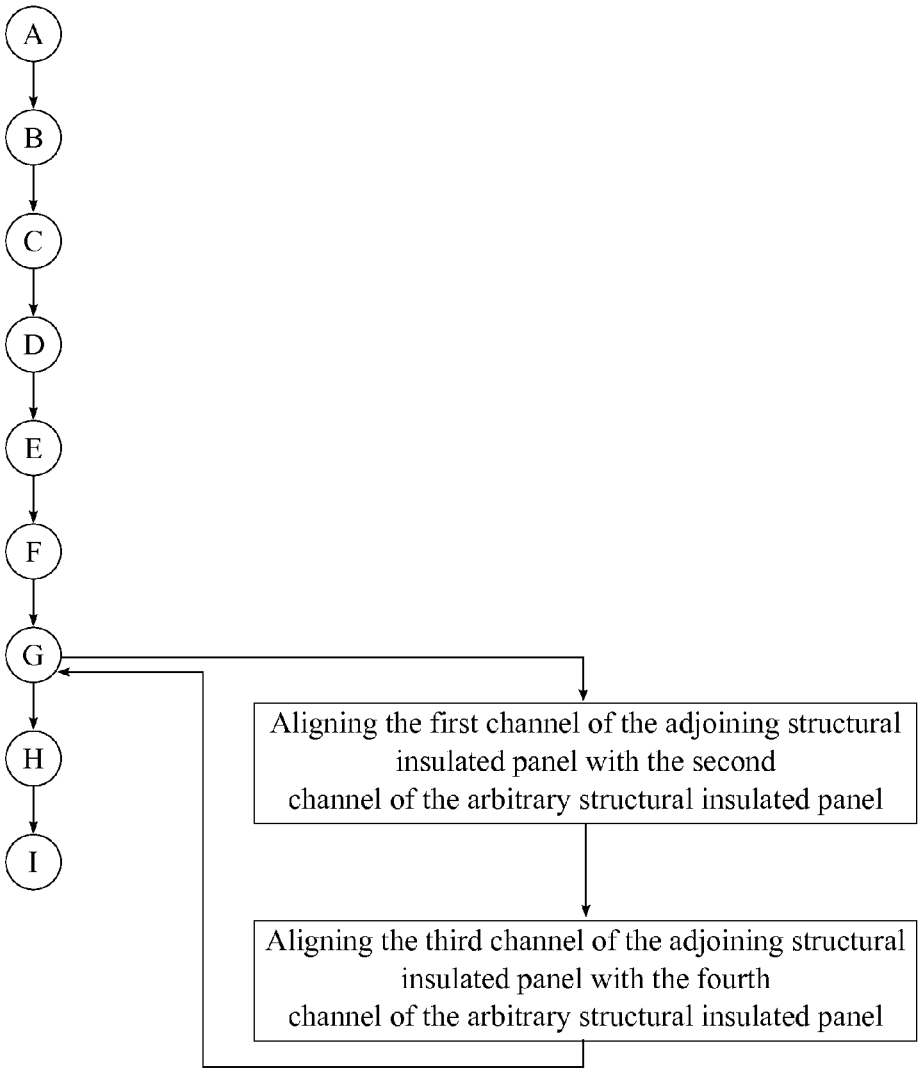
FIG. 10 is a basic flow chart illustrating the method of aligning of the adjoining structural insulated panel within the overall method of the present invention.
Figure 11:
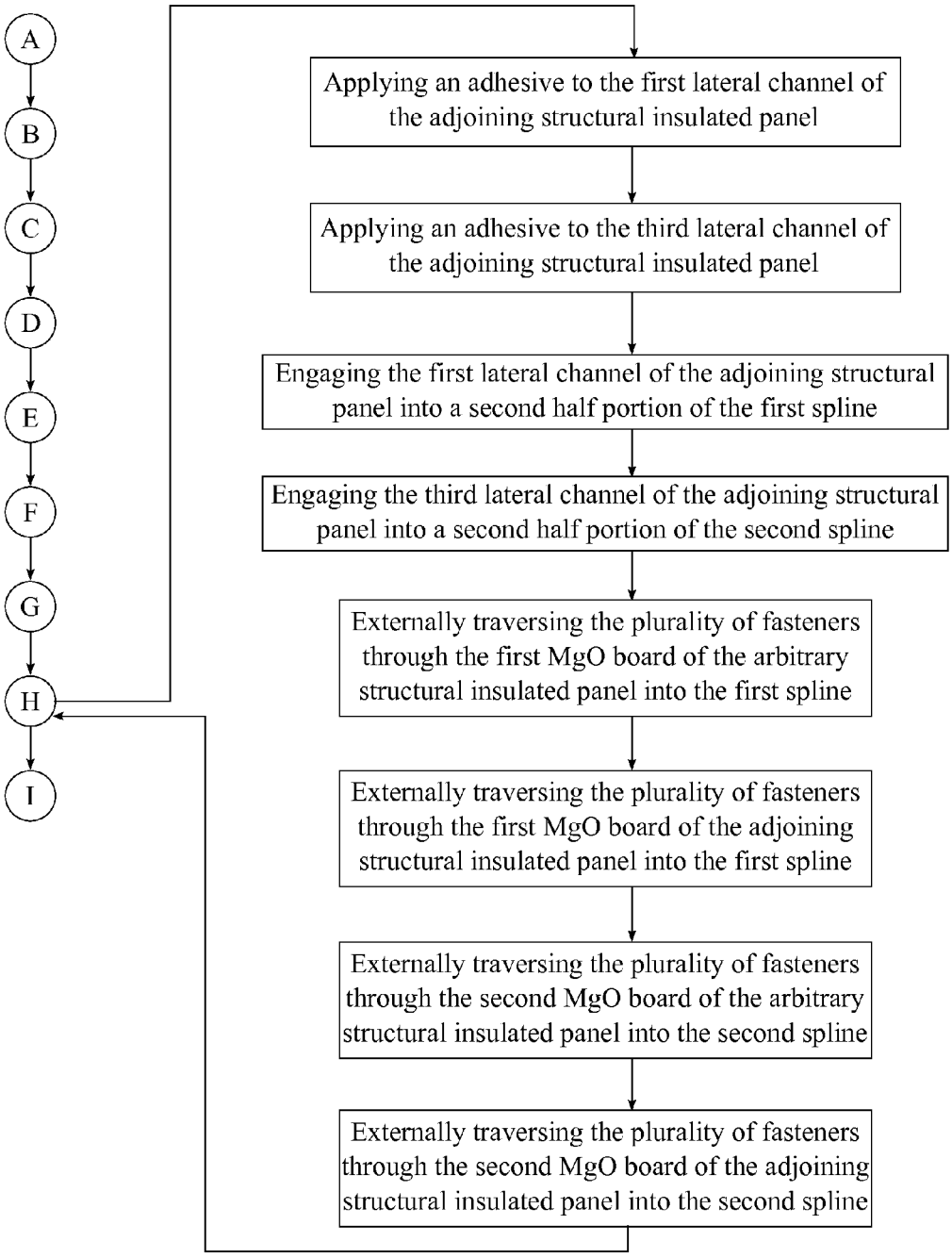
FIG. 11 is a basic flow chart illustrating the method securing the adjoining structural insulated panel within the overall method of the present invention.

In reference to FIG. 5, FIG. 6, and FIG. 7, the first spline 11 and the second spline 12, an adhesive is first applied to the second lateral channel 8 of the arbitrary structural insulated panel 1. Then a first half portion 15 of the first spline 11 is inserted into the second lateral channel 8 of the arbitrary structural insulated panel 1 in such way that the magnesium oxide board section 13 is adjacently positioned with the first MgO board 3. the adhesive is then applied to the fourth lateral channel 10 of the arbitrary structural insulated panel 1 so a first half portion 15 of the second spline 12 can be inserted into the fourth lateral channel 10 of the arbitrary structural insulated panel 1 in such way that the magnesium oxide board section 13 is adjacently positioned with the second MgO board 6. The adjoining structural insulated panel 2 is then linearly aligned with the arbitrary structural insulated panel 1 along the building floor foundation. More specifically, the first lateral channel 7 of the adjoining structural insulated panel 2 is aligned with the second lateral channel 8 of the arbitrary structural insulated panel 1, and the third lateral channel 9 of the adjoining structural insulated panel 2 is aligned with the fourth lateral channel 10 of the arbitrary structural insulated panel 1.

In reference to FIG. 7, the first spline 11 and the second spline 12 are secured to the adjoining structural insulated panel 2 in order secure the adjoining structural insulated panel 2 to the arbitrary structural insulated panel 1. More specifically, the adhesive is first applied to the first lateral channel 7 and the third lateral channel 9 of the adjoining structural insulated panel 2. Then the first lateral channel 7 of the adjoining structural insulated panel 2 is engaged with a second half portion 16 of the first spline 11 while the third lateral channel 9 of the adjoining structural insulated panel 2 is simultaneously engaged with a second half portion 16 of the second spline 12.

If the structural insulated panel with the seal section is used within the present invention, the seal section of the arbitrary structural insulated panel 1 is inserted into the first lateral channel 7 of the adjoining structural insulated panel 2 before inserting the second half portion 16 of the first spline 11. Then the seal section of the arbitrary structural insulated panel 1 can be sealed with the first lateral channel 7 of the adjoining structural insulated panel 2. The insertion of the first spline 11 further secures the seal section of the arbitrary structural insulated panel 1 within the third lateral channel 9 of the adjoining structural. Then the seal section creates a moisture barrier in between the arbitrary structural insulated panel 1 and the adjoining structural insulated panel 2 of the building envelope system in order to minimize the thermal break in between the arbitrary structural insulated panel 1 and the adjoining structural insulated panel 2.

The plurality of fasteners is then used to connect the adjoining structural insulated panel 2 with the arbitrary structural insulated panel 1 through the first spline 11 and the second spline 12. More specifically, the plurality of fasteners is externally traversed into the first spline 11 through the first MgO board 3 and the phenolic resin sheet 4 of the arbitrary structural insulated panel 1. The plurality of fasteners is also externally traversed into the first spline 11 through the first MgO board 3 and the phenolic resin sheet 4 of the adjoining structural insulated panel 2. Then the adjoining structural insulated panel 2 and the arbitrary structural insulated panel 1 can be attached to each other through the first spline 11 from the exterior side of the structural building. Similarly, the plurality of fasteners is externally traversed into the second spline 12 through the second MgO board 6 of the arbitrary structural insulated panel 1. The plurality of fasteners is also externally traversed into the second spline 12 through the second MgO board 6 of the adjoining structural insulated panel 2 so that the adjoining structural insulated panel 2 and the arbitrary structural insulated panel 1 can be attached to each other through the second spline 12 from the interior side of the structural building. As the final step, the adjoining structural insulated panel 2 is further secured to the building floor foundation by the plurality of fasteners.

Although the invention has been explained in relation to its preferred embodiment, it is to be understood that many other possible modifications and variations can be made without departing from the spirit and scope of the invention as hereinafter claimed.

What is claimed is:

1. A method of connecting the structural insulated building panels through connecting splines comprises the steps in combination of:

(A) providing an arbitrary structural insulated panel and an adjoining structural insulated panel, wherein the arbitrary structural insulated panel and the adjoining structural insulated panel each comprise a first magnesium oxide (MgO) board, a second magnesium oxide (MgO) board, a first lateral channel, a second lateral channel, a third lateral channel, and a fourth lateral channel;

(B) providing a first spline and a second spline, wherein the first spline and the second spline each comprise a magnesium oxide board section and a phenolic resin sheet section;

(C) perpendicularly positioning the arbitrary structural insulated panel on a building floor foundation;

(D) securing the arbitrary structural insulated panel to the building floor foundation by a plurality of fasteners;

(E) adhering the first spline into the arbitrary structural insulated panel;

(F) adhering the second spline into the arbitrary structural insulated panel;

(G) linearly aligning the adjoining structural insulated panel parallel with the arbitrary structural insulated panel along the building floor foundation;

(H) securing the first spline and the second spline to the adjoining structural insulated panel in order secure the adjoining structural insulated panel to the arbitrary structural insulated panel; and (I) securing the adjoining structural insulated panel to the building floor foundation by the plurality of fasteners.

2. The method of sealing the seal section of structural insulated building panel as claimed in claim 1, wherein:

an expanded polystyrene layer being sandwiched by the first MgO board and the second MgO board;

the first lateral channel and the second lateral channel being positioned adjacent to the first MgO board;

the first lateral channel and the second lateral channel being positioned opposite to each other across the expanded polystyrene layer;

the third lateral channel and the fourth lateral channel being positioned adjacent to the second MgO board;

the third lateral channel and the fourth lateral channel being positioned opposite to each other across the expanded polystyrene layer;

the first lateral channel and the third lateral channel traversing into the expanded polystyrene layer adjacent to each other; and the second lateral channel and the fourth lateral channel traversing into the expanded polystyrene layer adjacent to each other.

3. The method of sealing the seal section of structural insulated building panel as claimed in claim 1, wherein:

the magnesium oxide board section being laminated with the phenolic resin sheet section.

4. The method of sealing the seal section of the structural insulated building panel as claimed in claim 1 comprises the steps in combination of:

applying an adhesive to the second lateral channel of the arbitrary structural insulated panel;

inserting a first half portion of the first spline into the second lateral channel of the arbitrary structural insulated panel, wherein the magnesium oxide board section being adjacently positioned with the first MgO board;

applying the adhesive to the fourth lateral channel of the arbitrary structural insulated panel; and inserting a first half portion of the second spline into the fourth lateral channel of the arbitrary structural insulated panel, wherein the magnesium oxide board section being adjacently positioned with the second MgO board.

5. The method of sealing the seal section of the structural insulated building panel as claimed in claim 1 comprises the steps in combination of:

aligning the first lateral channel of the adjoining structural insulated panel with the second lateral channel of the arbitrary structural insulated panel; and aligning the third lateral channel of the adjoining structural insulated panel with the fourth lateral channel of the arbitrary structural insulated panel.

6. The method of sealing the seal section of the structural insulated building panel as claimed in claim 1 comprises the steps in combination of:

applying an adhesive to the first lateral channel of the adjoining structural insulated panel;

applying the adhesive to the third lateral channel of the adjoining structural insulated panel;

engaging the first lateral channel of the adjoining structural insulated panel into a second half portion of the first spline;

simultaneously engaging the third lateral channel of the adjoining structural insulated panel into a second half portion of the second spline;

externally traversing the plurality of fasteners through the first MgO board and a phenolic resin sheet of the arbitrary structural insulated panel into the first spline;

externally traversing the plurality of fasteners through the first MgO board and a phenolic resin sheet of the adjoining structural insulated panel into the first spline;

externally traversing the plurality of fasteners through the second MgO board of the arbitrary structural insulated panel into the second spline; and externally traversing the plurality of fasteners through the second MgO board of the adjoining structural insulated panel into the second spline.

* * * * *